US005718854A

United States Patent [19]

Nguyen

[11] Patent Number: 5,718,854

[45] Date of Patent: Feb. 17, 1998

[54] DETECTION OF BROKEN FILAMENTS

[75] Inventor: Young Dung-Thanh Nguyen, Kinston, N.C.

[73] Assignee: E. I. du Pont de Nemours and Company, Wilmington, Del.

[21] Appl. No.: 720,333

[22] Filed: Sep. 27, 1996

[51] Int. Cl.[6] ..... B29C 47/92; D01D 5/092

[52] U.S. Cl. ..... 264/40.1; 73/160; 264/130; 264/211.14; 340/677

[58] Field of Search ..... 264/40.1, 129, 264/130, 211.14; 73/160; 340/677

[56] References Cited

U.S. PATENT DOCUMENTS

| | | | |
|---|---|---|---|
| T886,007 | 5/1971 | Harvey et al. | 73/160 |
| 2,624,933 | 1/1953 | Quick et al. | 28/235 |
| 3,611,342 | 10/1971 | Raaben et al. | 340/677 |
| 4,110,654 | 8/1978 | Paul | 310/323 |
| 4,133,207 | 1/1979 | Weidmann et al. | 73/160 |
| 4,254,613 | 3/1981 | Arita et al. | 57/81 |
| 4,393,647 | 7/1983 | Kitamura | 57/81 |
| 4,605,875 | 8/1986 | Bobbola | 310/323 |
| 4,668,453 | 5/1987 | Ebnesajjad et al. | 264/78 |
| 5,034,174 | 7/1991 | Reese | 264/103 |
| 5,043,708 | 8/1991 | Kimura | 340/677 |
| 5,136,202 | 8/1992 | Carenzo et al. | 310/330 |

FOREIGN PATENT DOCUMENTS

| | | |
|---|---|---|
| 616 058 | 9/1994 | European Pat. Off. . |
| WO 92/01622 | 2/1992 | WIPO . |

OTHER PUBLICATIONS

Atochem Sensors, Inc., Product Data Number 61 (Aug. 1991), SW100 Switch, Aug., 91.

Ben H. Carlisle, Piezoelectric Plastics Promise New Sensors, *Machine Design,* 105–110, Oct. 23, 1986.

Kynar* Piezo Film Technical Manual, (1987), Pennwalt Corporation, Philadelphia, PA.

Kynar* Piezo Film Product Summary and Price List (1988), Pennwalt Corporation, Philadelphia, PA.

*Primary Examiner*—Leo B. Tentoni

[57] ABSTRACT

Individual broken filaments in a running threadline, e.g., freshly-melt-spun filaments, may be detected and recorded by a novel piezoelectric film sensor device.

2 Claims, 2 Drawing Sheets

DETECTION OF BROKEN FILAMENTS

FIELD OF INVENTION

This invention concerns detection of broken filaments, more particularly in a process of a preparing polymeric filaments, and especially a process of melt-spinning synthetic polymers, and in a device that is capable of detecting defects as small as a broken filament in such a process, or in other processes, and improvements in products resulting therefrom.

BACKGROUND OF THE INVENTION

Spinning of synthetic filaments from melts of synthetic polymers (melt-spinning), and from solvent solutions of synthetic polymers and of regenerated polymers (solvent-spinning), has been carried out commercially for much of the present century, and on a very large scale, amounting to millions of tons, and at high speeds, ranging from hundreds to thousands of meters/min. Most of such filaments are of fine dpf (denier per filament, 1 denier being the weight in grams of 9 km of the filament, and 1 dtex being the weight in grams of 10 km of the filament). There have been several suggestions in the art to detect "spinning drips", such as Harvey et al. U.S. Defensive Publication T886,007, published May, 1971, disclosing a slotted device for detecting oversize defects in yarns or filaments, and being particularly adapted to solvent spinning of synthetic fibers for detecting oversize filaments or polymer drips. Harvey's slotted device used a strain gauge, e.g., a type SPB2-15-200 strain gauge made by Baldwin Lima Hamilton, to measure strain fluctuations in a slotted guide (as oversized filaments or polymer drips would touch and deflect the guide). Harvey disclosed that the device would be used to indicate such an oversized defect, and could operate a cut-down device, so the filaments could be fed to waste, or a marking device to locate the defects. Actual practice on spinning positions has been to use a cut-out device, of various types.

It would be desirable to improve the ability to sense and mark defects in freshly-spun filaments without breaking out the whole end. As will be appreciated, freshly-spun undrawn synthetic filaments are very fragile and sensitive, so the problems involved in the control and monitoring of freshly-spun undrawn synthetic filaments are of an altogether different nature than for textile fibers, such as cotton, wool or drawn synthetic fibers.

In the 1970's, Weidmann et al, in U.S. Pat. No. 4,133,207 had proposed a device for detecting knot-like thick places in traveling textile threads, involving passing the textile thread through a gap between a thread guide and a mechanical vibratory system having a fundamental frequency below 100 Hz and comprising a vibratable plate-shaped or cantilever member and, secured thereto on one face, a mechanoelectrical transducer element which was a plate-shaped piezoelectrical structure responsive to vibration of the vibratable member. Weidmann's device could be used for assessing knots in weft threads on weaving machines, and on spinning and winding machines for assessing or counting knots or knot-like thick places. So far as is known, Weidmann's device was never used on a melt-spinning or solvent-spinning machine.

Piezoelectric elements have been suggested by several sources over the years for detecting disturbances in a running threadline, e.g., by Raaben et al (1971) in U.S. Pat. No. 3,611,342, Paul (1978) in U.S. Pat. No. 4,110,654, Arita et al (1981) in U.S. Pat. No. 4,254,613, Kitamura (1983) in U.S. Pat. No. 4,393,647, Bobbola (1986) in U.S. Pat. No. 4,605,875, Kimura (1991) in U.S. Pat. No. 5,043,708, and Atex (Savio et al, 1994) in EPA 616 058 A1. These typically were to detect breakage of yarns as a whole, not for detecting breakage of a single filament in a multifilament continuous filament yarn. Also, typically these prior suggestions were for use on textile machines, such as during ring-spinning, twisting, back winding or weaving, not on a melt-spinning position during initial extrusion from the melt, quenching or initial winding of freshly-quenched and spun filaments for yarns or tows.

As mentioned by Weidmann, supra, capacitative or opto-electrical transducers or sensing devices had been suggested for operation without touching a thread, but were expensive to manufacture. For example, The Technology Partnership Limited discussed several such thread detector devices in WO 92/01622 (1992) and suggested an ultrasonic acoustic wave system for such a purpose.

What has been lacking for all these years has been a practical device capable of detecting the presence of a single broken filament during, for example, melt-spinning while the rest of the threadline continues to run with unbroken filaments. Even relatively recently, Reese described in U.S. Pat. No. 5,034,174 the current practice of examining the ends of a completely wound bobbin of yarn for broken filaments, counting the number of broken filaments protruding from the ends of the bobbin to give a measure of the probable number of broken filaments in the yarn on the bobbin, and dividing the total number of protruding broken filaments counted by the number of pounds of yarn on the bobbin and expressing the result as BFC (Broken Filament Count). As will be recognized, this technique (recently used in practice) has been much inferior to detecting a filament broken during melt-spinning on that spinning position, but a practical method sensitive enough to detect a single broken filament on a melt-spinning threadline has not hitherto been available without a significant cost penalty, such as was mentioned by Weidmann as long ago as during the 1970s.

The present invention solves this long-standing problem. An essential element of my invention is the use of a piezoelectric film sensor in detecting a broken freshly-extruded synthetic filament on, e.g., a melt-spinning position. Piezoelectric film has been available commercially for some 10 years, but has not previously been suggested for use in solving this problem, despite various publications, e.g., by Ben Carlisle, in Machine Design, Oct. 23, 1986, pages 105–110, and Carenzo et al, U.S. Pat. No. 5,136,202, which refers to a technical manual and other literature on Kynar® Piezo Film, published in 1987 and 1988.

SUMMARY OF THE INVENTION

According to one aspect of the invention, therefore, there is provided an improvement in a process for melt-spinning a synthetic polymer into a multiplicity of filaments, comprising extruding the molten polymer through spinning capillaries into filamentary streams, quenching said filamentary streams with cooling air to harden the streams into filaments, and applying finish to said filaments, and wherein the improvement comprises the capability to sense and record the presence of a broken filament by passing said filaments past a flexible cantilever beam that is spaced from said filaments at a predetermined distance from said filaments, and wherein a piezoelectric film sensor is secured to said beam, and wherein said film sensor is part of an electric circuit containing also means for recording electric impulses from said film sensor, whereby impact from a filament defect on said beam will cause said beam to flex and stretch said film sensor, and will initiate an electric impulse from the film sensor in said electric circuit, and wherein said electric impulse is recorded.

The flexible cantilever beam that carries the piezoelectric film sensor is preferably formed with a free end that is spaced from a guide, so as to define a gap of predetermined width between the free end of the beam and the guide.

According to another aspect, there is provided a device that it suitable for detecting a broken filament in a multiplicity of filaments being moved continuously along a filament path comprising:

(1) a cantilever beam that has two faces and is flexible and of low inertia in a direction along said path, and that is spaced a predetermined distance from said path, (2) a piezoelectric film sensor that is permanently bonded to a face of said beam whereby, upon deflection of said beam by a broken filament or other filamentary defect, said piezoelectric film develops an electric signal, and (3) an electric circuit containing means for recording said electric signal.

This beam is preferably formed with a free end that is disposed on a first side of said path, and a guide member is disposed in opposite relationship to said free end such that a filament path gap of a predetermined width is formed between said free end and said guide member.

Other arrangements may be used, for instance the beam may be provided with a slot, so that the filament path passes through the slot which forms a filament path gap of predetermined width.

According to a further aspect, improved products such as improved yarns are provided as a result of applying the process improvements and of using the device of the invention and the lessons learned thereby.

DETAILED DESCRIPTION OF THE INVENTION

Figure 1:
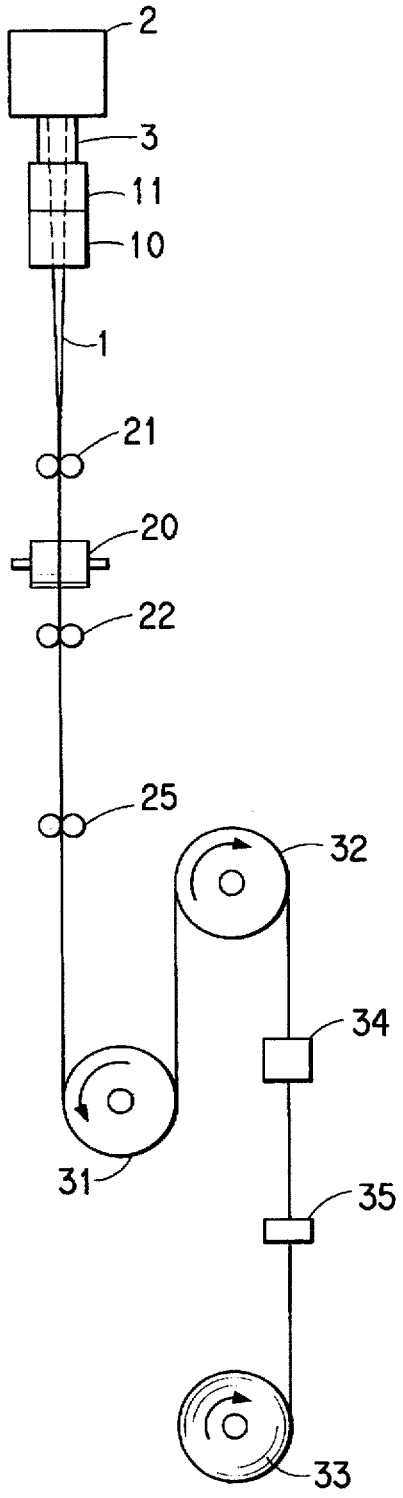
FIG. 1 (PRIOR ART)
FIG. 1 is a schematic illustration of a typical process for melt-spinning synthetic filaments according to the art.

The preferred embodiments of the invention will be described with reference to the accompanying drawings. Referring to FIG. 1, showing a typical high speed melt-spinning apparatus for use in preparing yarn, molten polyester is melt-spun through orifices in a heated spinneret block 2 and cooled in the atmosphere to solidify as filaments 1. As the molten polyester emerges from block 2, it may be protected from the atmosphere by a metal tube surrounding the filaments as they pass between the orifices and a zone 10 in which cooling air is introduced, e.g., symmetrically around the filaments through the holes in a foraminous metal tube 11. The filaments may optionally pass between convergence guides 21, which are arranged so as to confine the filaments, and then in contact with rolls 20 which rotate in a bath of spin-finish and thus apply the desired amount of finish to the solid filaments, or an alternative means of applying spin-finish, such as a metering device, and then pass another set of guides 22 which hold the filaments in contact with the finish roll 20 and direct the filaments to the next set of guides 25, and on to the windup system, which comprises a first driven roll 31, a second driven roll 32, a traversing guide 35 and a driven take up roll 33, the yarn being interlaced by an interlacing jet 34. Such a melt-spinning position has been described in U.S. Pat. No. 4,156,071 (Knox). Several variations may be used. For instance, interlacing jet 34 may be between rolls 31 and 32, or between guides 25 and roll 31, especially for a single-roll wind-up (or godet-less system), and, for staple, neither interlace nor wind-up are generally used but the filaments pass in a bundle from first driven roll 31 to a collecting device, usually for processing as tow, generally after combination with other bundles to make a larger tow bundle. As mentioned, hitherto, it has not generally been practical to use prior suggestions for monitoring defects when melt-spinning at high speed. So cleaner guides have been used, as described in art such as Quick, U.S. Pat. No. 2,624,933 or Ebnesajjad et al, U.S. Pat. No. 4,668,453, to break out the whole bundle of filaments as relatively large defects pass such cleaner guides. Such cleaner guides may be located conveniently along the melt-spinning threadline, e.g., where guides are shown at 22 or 25 or wherever convenient. According to my invention, however, a device for detecting a broken filament may be located instead of or in addition to such a cleaner guide at a similar location along a threadline for melt-spinning, or otherwise.

Figure 2:
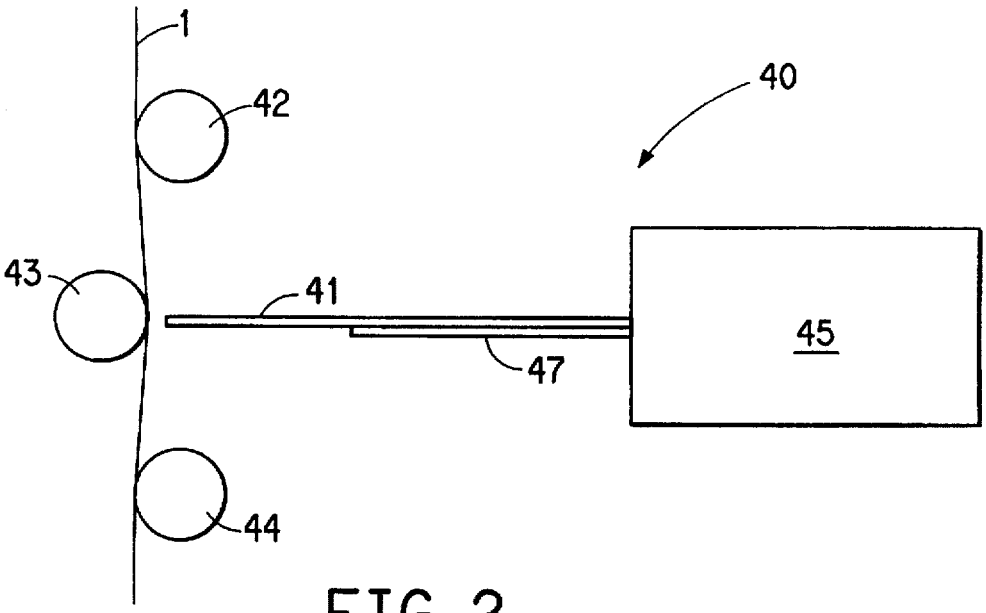
FIGS. 2 and 3 are schematic views of a preferred device according to the invention in elevation and plan-view, respectively.
Figure 3:
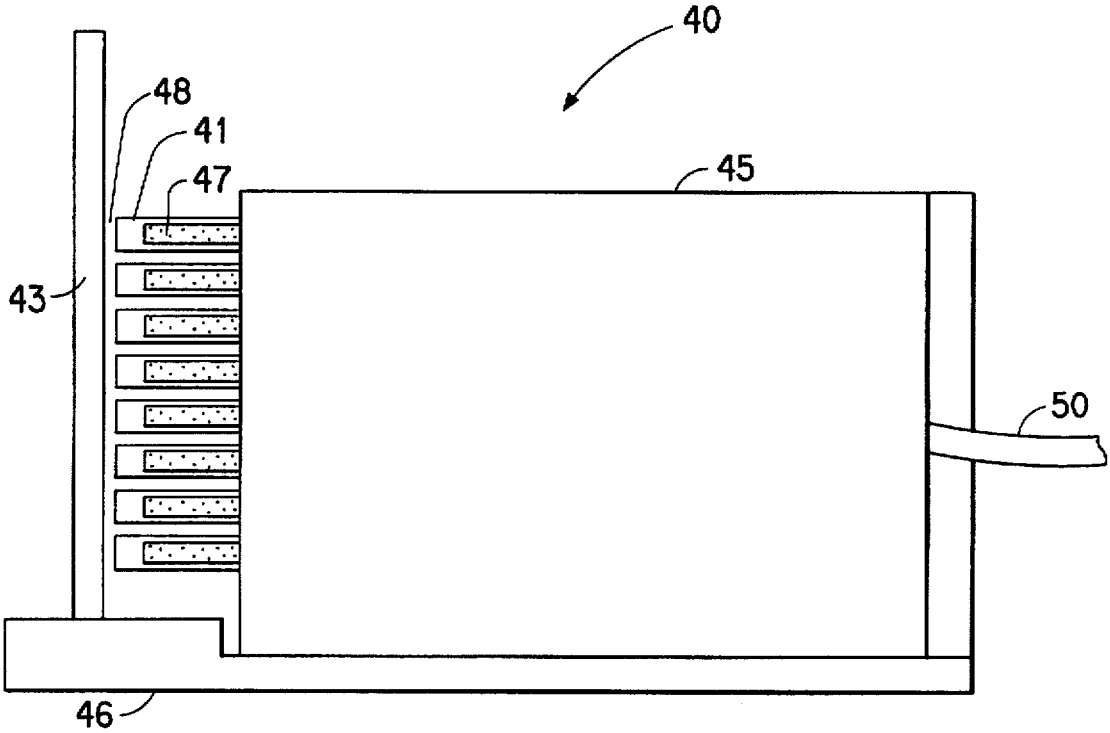

Referring now to FIG. 2, a broken filament detector, indicated generally as 40, is shown on the right side of FIG. 2, with cantilever beam 41 extending toward the threadline 1 as the latter passes between guides 42 and 44, both located on the same side of threadline 1 and located above and below beam 41 which is also located on the same side of threadline 1. Guide 43 is located on the far side of threadline 1, i.e., opposite to beam 41, so as to define a gap of predetermined width between guide 43 and beam 41 through which threadline 1 will pass as it is urged towards guide 43 by upper guide 42 and lower guide 44. This gap 48 is shown more particularly in FIG. 3, which does not show threadline 1, and is a plan view looking upward at detector 40 and guide 43. FIG. 3 is on a smaller scale than FIG. 2 and shows eight beams 41 extending from base 45 and guide 43, both being securely mounted on a rigid support 46. The eight beams 41 are flexible and may be made of stainless steel, e.g., 3–4 mils (0.075–0.1 mm) thick, and a piezoelectric film sensor 47 is secured to each of the beams 41.

The piezoelectric film sensor(s) 47 should be permanently bonded to the cantilever beam(s) 41, as the flexing of a beam should flex and strain the film sensor so as to detect the defect, such as a broken filament. FIG. 3 shows 8 beams 41 and piezoelectric film sensors 47 for 8 freshly-melt-spun filament bundles, side-by-side. As will be understood different configurations may be used, according to the array of filaments, bundles or yarns that are being forwarded past the detector device. For instance, for spinning a large bundle of filaments for a tow and processing into staple, a single larger cantilever beam may be used to stretch across the whole filament bundle.

Electronic circuitry for the piezoelectric film sensor may be as described by Atochem in Product Data Number 61 (8/91) or in Carenzo et al, U.S. Pat. No. 5,136,202 or the Kynar® Piezo Film Technical Manual (and Product Summary and Price List) referred to therein, and is also described in Weidmann et al., U.S. Pat. No. 4,133,207 (for a ceramic-type piezoelectrical transducer), and is not shown in FIGS. 2 and 3, except for an electrical conductor 50 to a source of electrical power supply. In other words, suitable electronic circuitry is available commercially.

As indicated, cantilever beams may be made of stainless steel 3 to 4 mils thick. Such dimensions have been used successfully to provide low beam inertia, high resiliency, and high deflection and signal responses. The width and length of the beams depend on specific applications and are basically determined by the width of the filament bundle (threadline) and the defects involved. Beam widths and lengths ranging, respectively, from 0.18 to 1 and 0.5 to 1.5 inches (4.5 to 25, and 12 to 40 mm) have been successfully tested and evaluated on different machine configurations and products.

Other materials instead of stainless steel may be used to construct the cantilever beams for desired sensor characteristics For example, brass and plastic beams may be used. However, for ease of fabrication and lower cost, stainless steel beams have proved to be adequate for typical applications.

The "sensing gap" dimension is adjusted for different applications as dictated by the thickness of the filament bundles, and the sensitivity requirements. In applications, gap sizes ranging from 4 mils to 30 mils (0.1 to 0.8 mm) have been tested successfully for a variety of product lines. The gap will generally, depending on the sensitivity desired, be 2 to 3 times the width of the filament bundle. Typical threadlines may be 1–3 mils (25–75 microns) thick. Generally, if practical, for maximum sensitivity it may be desirable to have a yarn bundle spread out on the guide, so as to present only one filament thickness, but this may not always be practical, especially when melt-spinning large filament bundles, e.g., for staple.

The operative parts of the sensing device, i.e., the piezoelectric film sensor(s) 47 (and, desirably, cantilever beam(s) 41) are preferably water-proofed, e.g., coated with a suitable waterproofing material. I have found it very important in practice, for melt-spinning applications, to protect the film from spin-finish, and I have used a commercially-available water proofing coating sold under the trade name Parylene, by Paratronic of Attleboro, Mass. to cover these parts up to base 45. In addition, the whole device, including base 45, which contains electronic circuitry, should desirably be sealed with a suitable material, e.g., a silicone sealant.

In contrast to attempts to use prior devices, which did not prove to be satisfactory, I have been able to detect and record broken filaments in individual bundles of freshly-melt-spun filaments using the process and device of my invention, and I have, thereby, been able to improve the quality of the resulting yarns as a result of my improved ability to detect broken filaments and other yarn defects, and, consequently, my ability to correct the reasons for such broken filaments and other defects. The improved yarns (of improved quality) are also provided according to my invention. Although the object of my invention and the greatest perceived need has been during melt-spinning, it will be recognized that my novel broken filament detector will have wider application in monitoring and recording defects in other running threadlines. According to the sensitivity of the settings of the device, it may be used to monitor single filament breaks, as I have done, and/or larger defects, such as drips, thick places or fused filaments, as was suggested by Harvey, for example. Also, in addition to monitoring a running threadline, devices according to the invention may be used as portable test devices for checking quality of threadlines off-line, i.e., separately from commercial manufacture. Sensitivity may be adjusted by varying the width of the gap; in this regard, a beam with a free end is capable of easier adjustment with respect to a guide, which may be fixed, than a slotted beam. Also the threshold sensitivity of the electrical recording may be adjusted, according to the amount the beam deflects, as may prove desirable in practice.

I claim:

1. An improvement in a process for melt-spinning a synthetic polymer into a multiplicity of filaments, comprising extruding the molten polymer through spinning capillaries into filamentary streams, quenching said filamentary streams with cooling air to harden the streams into filaments, and applying finish to said filaments, and wherein the improvement comprises the capability to sense and record the presence of a filament defect by passing said filaments past a flexible cantilever beam that is spaced from said filaments at a predetermined distance from said filaments, and wherein a piezoelectric film sensor is secured to said beam, and wherein said film sensor is part of an electric circuit containing also means for recording electric impulses from said film sensor, whereby impact from a filament defect on said beam will cause said beam to flex and stretch said film sensor, and will initiate an electric impulse from the film sensor in said electric circuit, and wherein said electric impulse is recorded.

2. A process according to claim 1, wherein the piezoelectric film sensor is protected by a waterproof coating.

* * * * *